United States Patent [19]

Hollingsworth

[11] 4,287,054

[45] Sep. 1, 1981

[54] FLOTATION APPARATUS FOR CONCENTRATION OF MINERALS

[75] Inventor: Clinton A. Hollingsworth, Lakeland, Fla.

[73] Assignee: The Deister Concentrator Co., Inc., Fort Wayne, Ind.

[21] Appl. No.: 145,130

[22] Filed: May 5, 1980

[51] Int. Cl.[3] ..... B03D 1/24

[52] U.S. Cl. ..... 209/170; 210/221.2

[58] Field of Search ..... 209/168, 170, 138, 139 R, 209/474-476, 496, 494, 158-161; 210/221 P

[56] References Cited

U.S. PATENT DOCUMENTS

| | | | |
|---|---|---|---|
| 1,312,754 | 8/1919 | Rowand | 209/170 |
| 1,374,499 | 4/1921 | Greenawalt | 209/168 X |
| 1,378,920 | 5/1921 | Towne et al. | 209/170 X |
| 1,410,781 | 3/1922 | Towne et al. | 209/170 |
| 3,322,272 | 5/1967 | Evans | 209/170 X |
| 3,370,938 | 2/1968 | Newman et al. | 209/474 X |
| 3,371,779 | 3/1968 | Hollingsworth et al. | 209/170 X |

FOREIGN PATENT DOCUMENTS

| | | | |
|---|---|---|---|
| 545385 | 3/1977 | U.S.S.R. | 209/170 |

*Primary Examiner*—Ralph J. Hill

*Attorney, Agent, or Firm*—Gust, Irish, Jeffers & Hoffman

[57] ABSTRACT

The invention relates to the concentration and benefication of particulate matter by froth flotation and in particular to improvements in hydraulic-pneumatic flotation apparatus which contributes to efficiency of operation. Such apparatus employs a constriction plate which separates vertically arranged flotation and aerating compartments. A discharge duct may be used to extend through the aerating compartment and to open through the constriction plate centrally thereof. Orifices in both the constriction plate and the discharge duct are in communication with the aerating compartment to provide a uniform dispersion of air bubbles in the flotation compartment. To prevent build-up of non-float fraction on the constriction plate, the latter may be dish-shaped toward the discharge opening. In an alternative embodiment, the discharge duct is omitted and the constriction plate is conically shaped with the apex uppermost. To minimize development of circulating currents, baffle plates may be used in the flotation compartment.

36 Claims, 11 Drawing Figures

FLOTATION APPARATUS FOR CONCENTRATION OF MINERALS

BACKGROUND OF THE INVENTION

1. Field of the Invention

The present invention relates to hydraulic-pneumatic flotation appartus and more particularly to improvements therein for increasing efficiency of operation.

2. Description of the Prior Art

Commerically valuable minerals, for example, metal sulfides, apatitic phosphates and the like, are commonly found in nature mixed with relatively large quantities of gangue materials, and as a consequence it is usually necessary to beneficiate the ores in order to concentrate the mineral content thereof. Mixtures of finely divided mineral particles and finely divided gangue particles can be separated and a mineral concentrate obtained therefrom by well known froth flotation techniques. Broadly speaking, froth flotation involves conditioning an aqueous slurry or pulp of the mixture of mineral and gangue particles with one or more flotation reagents which will promote flotation of either the mineral or the gangue constituents of the pulp where the pulp is aerated. The conditioned pulp is aerated by introducing into the pulp a plurality of minute air bubbles which tend to become attached either to the mineral particles or to the gangue particles of the pulp, thereby causing these particles to rise to the surface of the body of pulp and form thereat a float fraction which overflows or is withdrawn from the flotation apparatus.

Typical of such flotation apparatus for accomplishing the foregoing is that disclosed in U.S. Pat. No. 3,371,779. In such apparatus, the conditioned pulp is introduced into a flotation compartment containing a relatively quiescent body of an aqueous pulp, and aerated water is introduced into the lower portion of the flotation compartment through orifices formed in the bottom wall of the flotation compartment. A body of aerated water is established in a hydraulic compartment disposed directly below the flotation compartment by introducing air and water into the hydraulic compartment while simultaneously dispersing a multitude of fine air bubbles throughout the water in the hydraulic compartment. The body of aerated water in the hydraulic compartment is in fluid communication with the aqueous pulp in the lower portion of the flotation compartment through the aforementioned orifices formed in the bottom wall of the flotation compartment. An overflow fraction containing floated particles of the pulp is withdrawn from the top of the body of aqueous pulp and an underflow or non-float fraction containing non-floated particles of the pulp is withdrawn from the pulp in the lower portion of the flotation compartment.

In a modification of such apparatus, the underflow of non-float fraction is withdrawn from the central portion of the bottom wall of the flotation compartment by means of a discharge pipe opening through the wall. By reason of the discharge opening being in the central portion of this bottom wall, otherwise referred to as a constriction plate, for certain sized flotation compartments, in inefficiency in operation results due to the non-uniformity in aeration in the flotation compartment immediately above the constriction plate and more particularly in the vicinity of the discharge opening. Due to the absence of aeration immediately above the discharge opening, the particulate matter, including the float fraction tends to recirculate and discharge through the opening. This results, then, in the loss of some of the desired float fraction of mineral.

A further problem encountered involves the removal of coarse and heavy particles of ore contained in coarse feed of a size of about plus 14 mesh. With the constriction plate being flat and horizontally disposed, the coarse particles tend to settle and to collect onto the constriction plate thereby forming a relatively thick bed. This bed overlies and at least partially plugs the orifices thereby inhibiting the passage of aerated water and more particularly tiny air bubbles into the flotation chamber. Instead, the tiny bubbles combine internally of the bed and release in the form of relatively large bubbles which defeat the flotation function. In order to restore proper aeration of tiny bubbles rising in the flotation chamber, the bed of agglomerated material must be removed, requiring in some instances equipment shut-down.

Other prior art relating to the concentration of minerals is disclosed in U.S. Pat. Nos. 2,753,045, 2,758,714 and 3,298,519.

SUMMARY OF THE INVENTION

The apparatus of this invention overcomes one or more of the foregoing problems thereby contributing to efficiency of operation. This apparatus comprises a flotation compartment adapted to contain a relatively quiescent body of aqueous pulp. Pulp feed means is provided for introducing aqueous pulp into the flotation compartment. Froth overflow means is disposed adjacent to the upper end of the flotation compartment and provides for the discharge of a float fraction containing floated particles of the aqueous pulp. A hydraulic compartment is disposed beneath the flotation compartment and is adapted to contain a body of aerated water maintained at a higher static pressure than that of the aqueous pulp in the lower portion of the flotation compartment. A constriction plate separates the flotation compartment from the hydraulic compartment disposed therebeneath, the constriction plate having a plurality of spaced orifices for uniformly distributing aerated water thereacross from the hydraulic compartment in transit to the flotation compartment. Each orifice is adapted to receive therethrough a stream of aerated water from the hydraulic compartment into the lower portion of the flotation compartment.

Means is provided for introducing air and water into the hydraulic compartment and for forming a multitude of air bubbles throughout the water in the hydraulic compartment, such means conventionally including an aspirating device but not restricted thereto.

Underflow means is provided for discharging a non-float fraction containing unfloated particles of said aqueous pulp from the flotation compartment, the underflow means including in one instance a discharge pipe which opens through the constriction plate. Means are provided for introducing air bubbles into the discharge pipe, in one form this means including a number of orifices in the discharge pipe in communication with the hydraulic compartment. Another means would be a separate aspirator. A valve device serves in controlling the velocity of outflow through the discharge pipe such that the last-mentioned air bubbles rise into the flotation compartment. Aerated water is thus distributed into the flotation compartment uniformly across the area of the constriction plate as well as the discharge opening therethrough thereby preventing the development of recirculating currents, as mentioned hereinabove, the flotation chamber which could contribute to loss in efficiency by reason of the undesired discharge of some of the float fraction.

A different arrangement for inhibiting the development of such recirculating currents comprehends the use of baffle plates in the flotation compartment, which upstand from the constriction plate. These baffle plates are spaced both peripherally and transversely of the flotation compartment in such configuration as to impede cross currents and otherwise provide channel-like columns which serve as vertical guides for the air bubbles.

With respect to the problem discussed in the preceding of the plugging of the orifices in the constriction plate by a bed of the heavier, non-float particles, the constriction plate is formed to incline outwardly from the opening into the discharge pipe whereby non-float fractions which tend to collect on the plate gravitate toward and out of the opening. Alternatively, the constriction plate may be conically shaped with the apex portion uppermost: no discharge pipe would be required in this arrangement. Particles that tend to collect on the plate thus gravitate outwardly to be discharged into an outflow passage that surrounds the plate. Thus, no inhibiting bed develops. Means are provided for selectively distributing aerating water in the hydraulic compartments substantially uniformly across the constriction plate, such means including a plurality of air bubble entrapping compartments depending from the constriction plate in communication with discrete, different groups of the orifices therein. The bubbles in the aerated water of the hydraulic compartment are trapped in the individual compartments and escape therefrom only through the respective orifices. Without such entrapping compartments, the bubbles would tend to rise in the hydraulic compartment to the uppermost portion of the constriction plate and pass through only the uppermost orifices thereby resulting in non-uniform aeration of the water in the flotation compartment.

In view of the foregoing it is an object of this invention to provide for improvements in flotation apparatus for achieving an increase in operating efficiency.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE EMBODIMENTS

Figure 1:
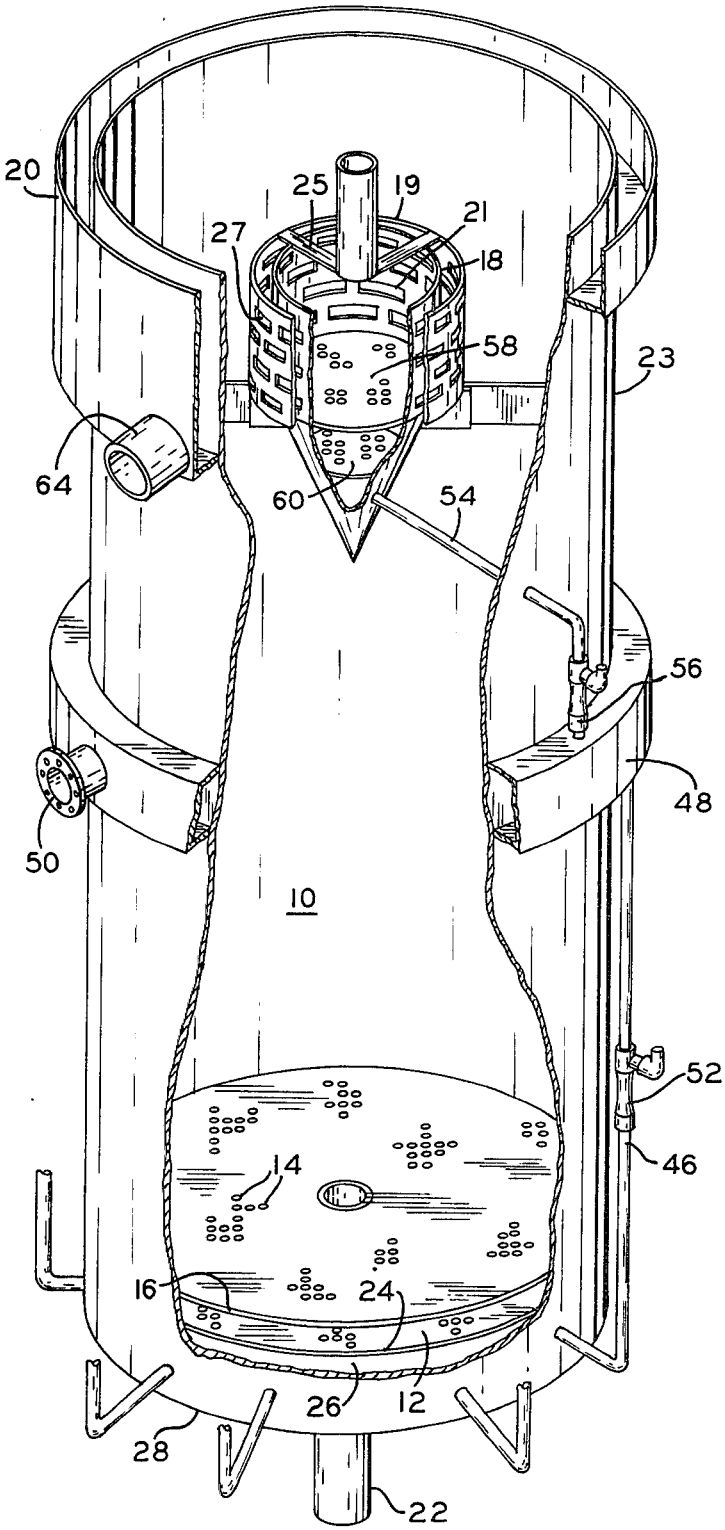
FIG. 1 is a perspective view partially broken away and sectioned for clarity of illustration of a flotation apparatus of the type to which the present invention relates.

Referring to FIG. 1 for a general description, the flotation apparatus comprises a flotation compartment 10 adapted to contain a body of aqueous pulp to be separated into float and non-float fractions, a hydraulic compartment 12 disposed directly below the flotation compartment 10 and adapted to contain a body of aerated water that is introduced into the flotation compartment through orificies 14 formed in the constriction plate 16 which serves as the bottom wall of the compartment 10. An apertured pulp feed well 18 is provided adjacent the upper end of the apparatus for introducing a conditioned aqueous pulp into the flotation compartment 10, and an apertured dispersion sleeve 19 coaxially surrounds the feed well 18. An annular, froth overflow launder 20 is provided adjacent to the upper end of the flotation compartment 10 for withdrawing the float fraction therefrom. Low velocity underflow discharge means 22 is provided adjacent to the lower end of the flotation compartment 10 for withdrawing underflow or non-float material from the flotation compartment 10.

Figure 4:
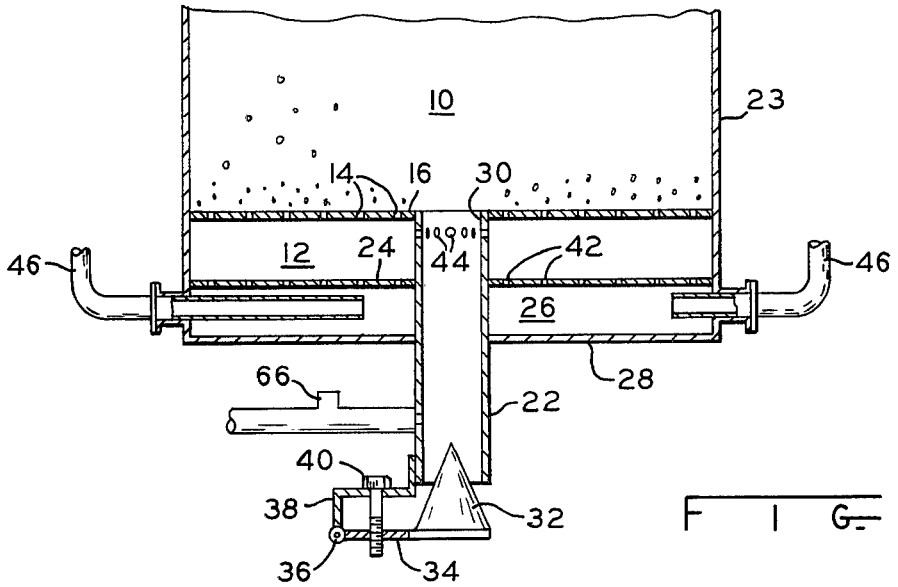
FIG. 4 is a partial longitudinal section of a second embodiment of this invention.
Figure 5:
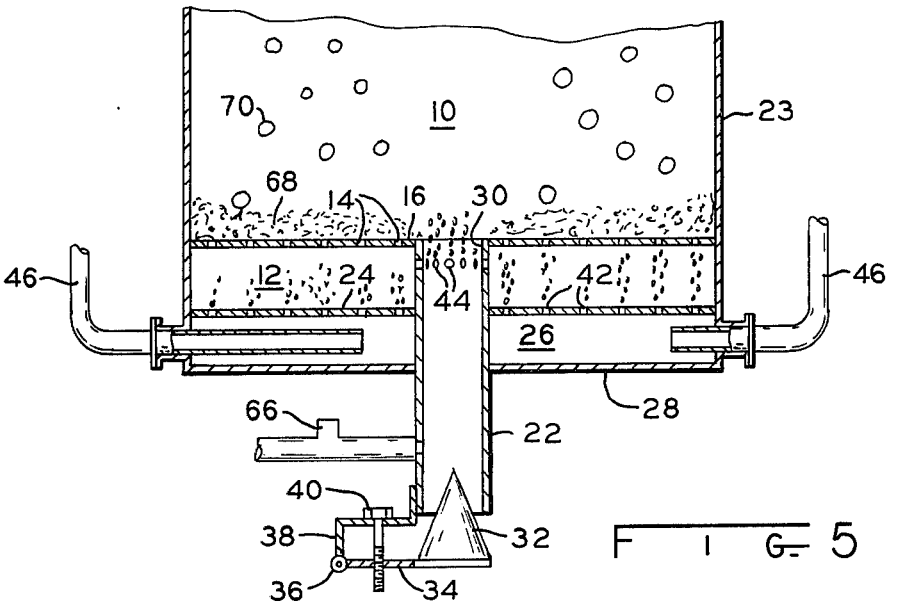
FIG. 5 is a view like FIG. 4 used in explaining the principle of operation of the embodiment of FIG. 4.

The flotation compartment 10 has a substantially circular cross-section defined by the cylindrical wall 23, the constriction plate 16 serving, as previously noted as the bottom wall of the flotation compartment 10. The hydraulic compartment 12 is defined by the constriction plate 16 which serves as the top wall thereof, by the cylindrical wall 23 and a second constriction plate 24 spaced below and extending parallel to the constriction plate 16, the constriction plate 24 serving as the bottom wall of the hydraulic compartment 12. An aerating chamber 26 is disposed beneath and in parallelism with the hydraulic compartment 12 and is defined on the upper side thereof by the constriction plate 24, at the sides by a cylindrical wall 23 and at the bottom by the bottom wall 28 of the apparatus. The underflow discharge means 22 is in the form of a straight duct or pipe coaxially centered with respect to the wall 23 and sealingly secured at its upper end to and opening through the constriction plate 16, such opening being indicated by the numeral 30 (FIGS. 4 and 5). The constriction plate 24 is sealingly secured to the outer periphery of the pipe 22 as shown as is the bottom wall 28. A cone-shaped valve 32 is disposed for movement within the lower end of the pipe 22 as shown, the valve 32 being mounted on a lever 34 pivoted at 36 to a bracket 38 secured to the lower end of the pipe 22. A screw adjustment 40 is received by the bracket 38 and threads into the lever 34, rotation of the screw 40 serving to move the valve 32 vertically. The valve 32 serves in controlling the rate of discharge of water and non-float fraction from the flotation compartment 10.

Figure 3:
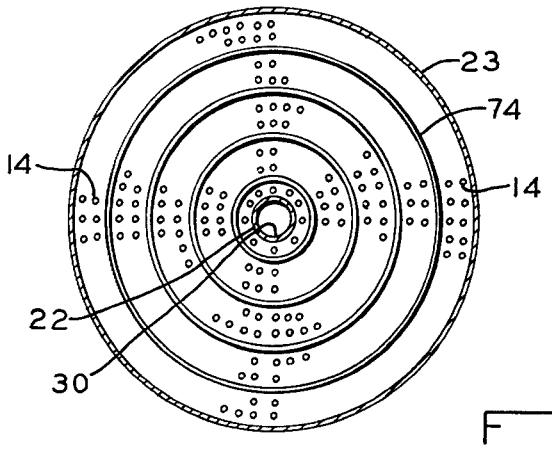
FIG. 3 is a cross-section taken substantially along section line 3—3 of FIG. 2.

The orifices 14 in the constriction plate 16 are uniformly spaced, such as on two to three inch centers, as shown in FIG. 3 and in one working embodiment are of a size ranging from $\frac{1}{8}$ to 5/16th inch. The openings 42 in the constriction plate 24 are also spaced and arranged according to essentially the same pattern as the orifices 14 with the exception that they are larger, an example being $\frac{5}{8}$th inch.

In the upper end of the discharge pipe 22 and spaced a suitable distance beneath the constriction plate 16 is an annular series of orifices 44, (FIGS. 4 and 5) in direct communication with the hydraulic compartment 12. In a working embodiment, these orifices 44 are spaced about 1 inch beneath the plate 16 and are of about the same size and spacing as orifices 14.

Figure 11:
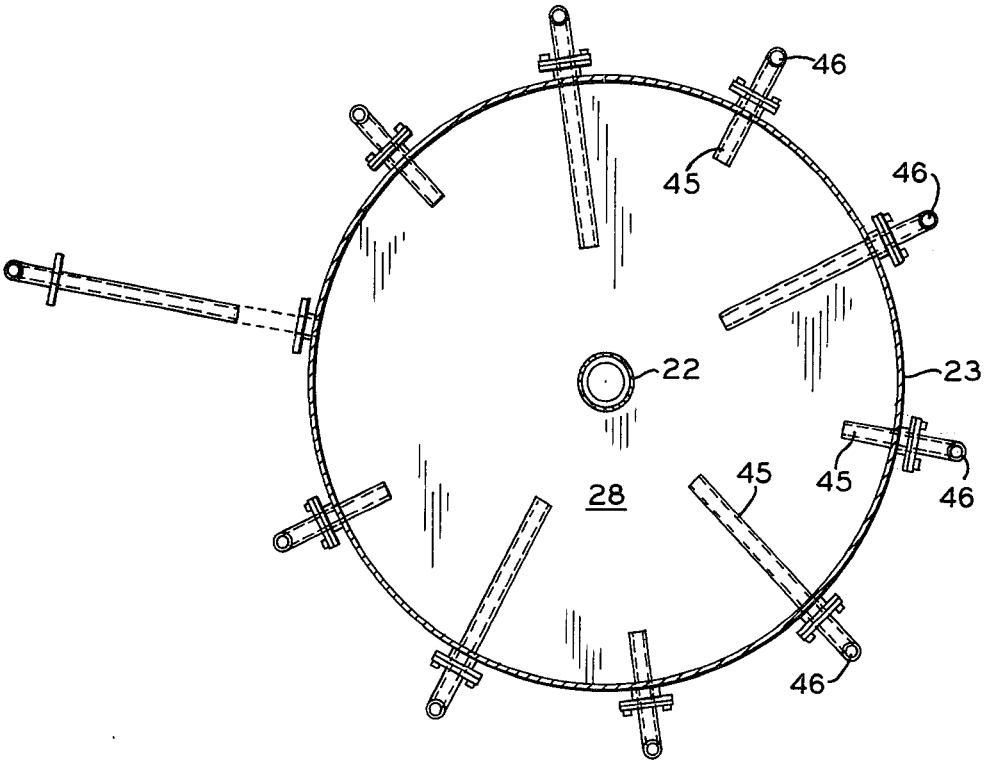
FIG. 11 is a cross-section taken on section line 11—11 of FIG. 2.

It is important that the hydraulic compartment 12 contain a uniformly aerated body of water maintained at a slighty higher pressure than that of the aqueous pulp in the flotation compartment 10. Accordingly, the hydraulic compartment 12 is provided with means for introducing air and water thereinto and with means for forming a uniform dispersion of minute air bubbles through the water in the compartment. The functions of the air and water introducing means as well as the air dispersing means may be essentially the same as disclosed in U.S. Pat. No. 3,371,779, but as shown in the drawings, are alternatively provided in part by the constriction plate 24, the compartment 26 having therein a series of circumferentially arranged, radial pipe extensions 45 (FIG. 11) of different length. These extensions 45 are connected to pipes 46 leading to an annular, water manifold 48 having a fitting 50 to which water at a pressure of, for example, 25 to 50 pounds per square inch is connected. In series with each of the pipes 46 is a conventional aspirator 52. Such an aspirator may be the same as that shown in the aforesaid U.S. Pat. No. 3,371,779.

Another pipe 54 is connected at one end to the manifold 48 and at the other end to the feed well 18. An aspirator 56 like the aspirator 52 is connected in series with the pipe 54.

It is important in the operation of the apparatus described that water and aerating air be introduced into the hydraulic compartment 12 at a rate sufficient to insure that the static pressure in the hydraulic compartment 12 is above the static pressure of the aqueous pulp in the lower portion of the flotation compartment 10. Specifically, it has been found that the pressure differential between the aerated water in the hydraulic compartment 12 and the aqueous pulp in the lower portion of the flotation compartment 10 not be permitted to fall below about 0.5 pounds per square inch, and preferably not below about 1 pound per square inch, in order to maintain the hydraulic compartment 12 substantially free of aqueous pulp. A preferred operating range is from about 2 to 4 pounds per square inch.

Water flowing in the pipes 46 and 54 is mixed with air drawn from the surrounding atmosphere by means of the aspirators 52 and 56, respectively. The water flowing into the aerating compartment 26 is thus aerated, this aerated water flowing upwardly through the orifices in the constriction plates 24 and 16 into the flotation compartment 10. The orifices 14 and 42, (FIGS. 4 and 5) respectively, receive therethrough a plurality of streams of uniformly aerated water. In this connection, it is important to note that the constriction plates 16 and 24 are not primarily air diffusers and that the orifices in the constriction plates are not intended to control the size of the air bubbles, the stream of water flowing through each orifice already being aerated with a multitude of minute, uniformly dispersed air bubbles. The orifices 14 in the constriction plate 16 are relatively large and are distributed in a relatively widely spaced geometric pattern across the entire area of the constriction plate in order to ensure uniform distribution of the aerated water being introduced into the flotation compartment and, thereby to insure uniform aeration of the aqueous pulp in the flotation compartment.

Since the discharge opening 30 in the constriction plate 16 constitutes an interruption in the geometric pattern of the orifices 14, the orifices 44 in the discharge pipe 22 serve in providing aerated water, hence air bubbles, which rise through the opening 30 into the flotation compartment 10. This then serves to provide a substantially uniform dispersion of air bubbles across the entire areas of the constriction plate 16 as well as the discharge opening 30. In operation, the pulp to be separated is delivered at a suitable rate into the feed well 18 where it encounters aerated water delivered thereto by the pipe 54, this aerated water passing upwardly through spaced, apertured, constriction plates 58 and 60 therein to provide an aerated body of water which carries the floatable fractions upwardly and horizontally into the flotation compartment 10. The usual flotation reagents as disclosed in the aforesaid U.S. Pat. No. 3,371,779 are introduced into the feed well as desired by first being thoroughly mixed with the pulp feed before it is fed to the feed well 18.

More specifically, the wall of the feed well 18 is provided with apertures 21 either round or elongated, the latter being preferred, also, the dispersion sleeve 19 is provided with like apertures 27, sleeve 19 being mounted on the feed well 18 by means of bar-like braces 25. Aerated pulp not only flows upwardly out of the well 18 but also through apertures 21 and 27, there to encounter further aeration in the compartment 10. The presence of the apertures 21 and 27 tends to reduce turbulence and boiling and to disperse the content of the feed well less vigorously than would be the case if no apertures were used. The elongated, circumferential arrangement of the apertures provides a ribbon-like, radial flow offering maximum exposure to the levitating bubbles in compartment 10.

The froth that forms on the upper surface of the aqueous pulp in the flotation compartment 10 contains the floatable particles from the aqueous pulp which overflows into the annular launder 20 and out of the float discharge pipe 64. The essentially non-floatable particles entering the flotation compartment 10 gravitate downwardly to be discharged through the pipe 22. The rate of discharge as explained previously is controlled by means of the valve 32. The floatable particles not captured and floated at the feed well as they settle through flotation compartment 10 are subjected to continuous floating action by the rising bubbles in the compartment 10. The pulp feed in thereby separated in the manner described in the aforesaid U.S. Pat. No. 3,371,779 into the desired and undesired contituents.

Further considering the operation, and referring to FIG. 4, if the orifices 44 in the discharge pipe 22 were not present, a column immediately above the discharge opening 30 would have no air bubbles therein. By reason of the downflow through the discharge opening 30, circulating or recirculating currents develop within the flotation compartment 10 which carry with them both floatable and non-floatable fractions downwardly and out of the discharge pipe 22. The float fractions thus discharged represent a loss of desired constituents reflected as a loss of efficiency in the operation of the apparatus. However, by use of the orifices 44, the circulating or recirculating currents are avoided and air bubbles rise into the flotation compartment 10 to join the bubbles which emanate from the constriction plate 16.

Greater efficiency in the operation of the apparatus is thereby realized.

While the use of the aerating apertures 44 are desired in all sizes of the apparatus, they have been found to be more effective in the larger apparatuses, those which are 6½ feet or larger in diameter. While use of the orifices 44 in the discharge pipe 22 are preferred, an alternative or additional arrangement for introducing air bubbles into the discharge pipe 22 may be in the form of any eductor or aspirator 66 (FIGS. 4 and 5) which is connected to the water manifold 48, the aspirator 66 being of the same design as the aspirators 52 and 56. An alternative could be the addition of compressed air into pipe 22 by means of a suitable pipe or nozzle.

In the use of any such aerating arrangements, it is important that the velocity of water discharged through the pipe 22 be controlled to be less than the velocity of the rising bubbles in the pipe 22 itself. The problems previously discussed regarding the circulating and recirculating currents within the flotation compartment 10 are thus avoided.

Figure 2:
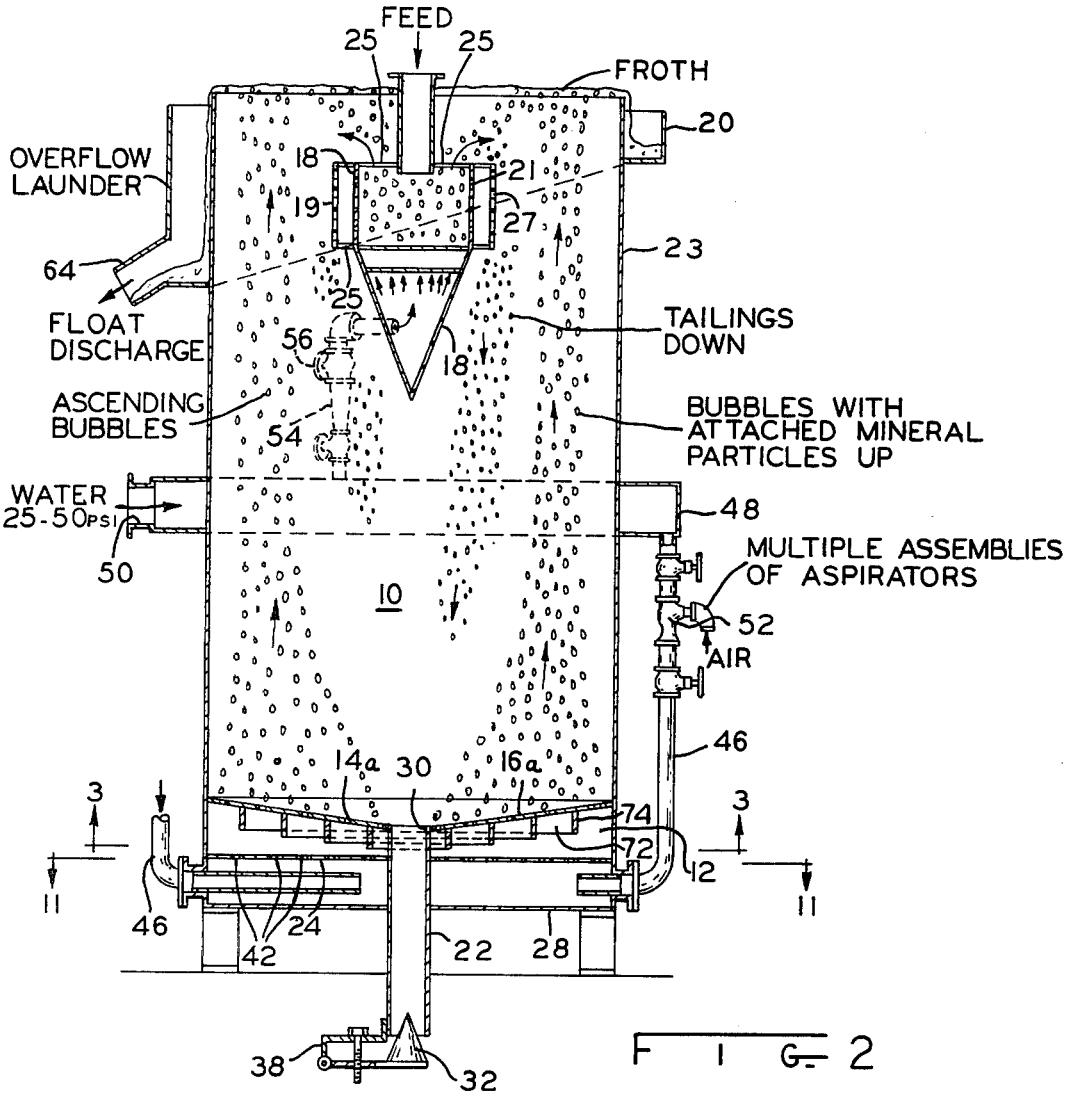
FIG. 2 is a longitudinal section view of a preferred embodiment of this invention.

Now referring more particularly to FIGS. 2 and 5, and first to FIG. 5, in the handling of coarse feed having a size of, for example, plus 14 mesh, it is possible for the coarser, nonfloat fraction to settle onto the constriction plate 16 to a sufficient thickness as forms a bed of particles indicated by the numeral 68. The bed 68 thus in effect plugs or clogs the orifices 14 interfering with the passage of the tiny air bubbles upwardly into the flotation compartment 10. Instead, the tiny bubbles entering the bed 68 tend to form into relatively large bubbles which eventually erupt through the bed and float upwardly in the form indicated by the numeral 70. Thus, the character of the tiny bubbles is altered seriously reducing flotation efficiency and in some instances destroying the flotation function completely.

The arrangement shown in FIG. 2 avoids this problem of the formation of the particulate bed 68. In this arrangement, the constriction plate **16*a* which separates the flotation compartment 10 from the hydraulic compartment 12 is dish or conically shaped from the discharge opening 30 as shown. An angle of inclination of about three to ten degrees is normally satisfactory. This constriction plate 16*a* is provided with orifices 14*a* of suitable size and arrangement as the orifices 14 previously described. Shallow air entrapping compartments are provided on the underside of the constriction plate 16*a* in order to prevent the air bubbles in the hydraulic compartment 12 from naturally migrating toward the highest portions thereof and generally concentrating for passage through those orifices 14*a* in only the outer peripheral portion of the constriction plate 16*a*. These compartments in the embodiment shown are indicated by the numeral 72 and are formed by concentric tubular walls or rings 74 sealingly secured at one end to the constriction plate 16*a*. Thus, the air bubbles in the compartment 12 that rise into the respective compartment 72 are there trapped and pass outwardly therefrom only through the respective orifices 14*a*. This ensures a uniform distribution of air bubbles upwardly from the constriction plate 16*a*. Any particulate matter that tends to settle out onto the constriction plate 16*a* tends to slide or gravitate down the inclination of the constriction plate 16*a* until it passes outwardly through the discharge opening 30 in pipe 22. Clogging of the constriction plate 16*a* is thus prevented. Orifices 44** in the discharge pipe may or may not be used as desired.

Figure 6:
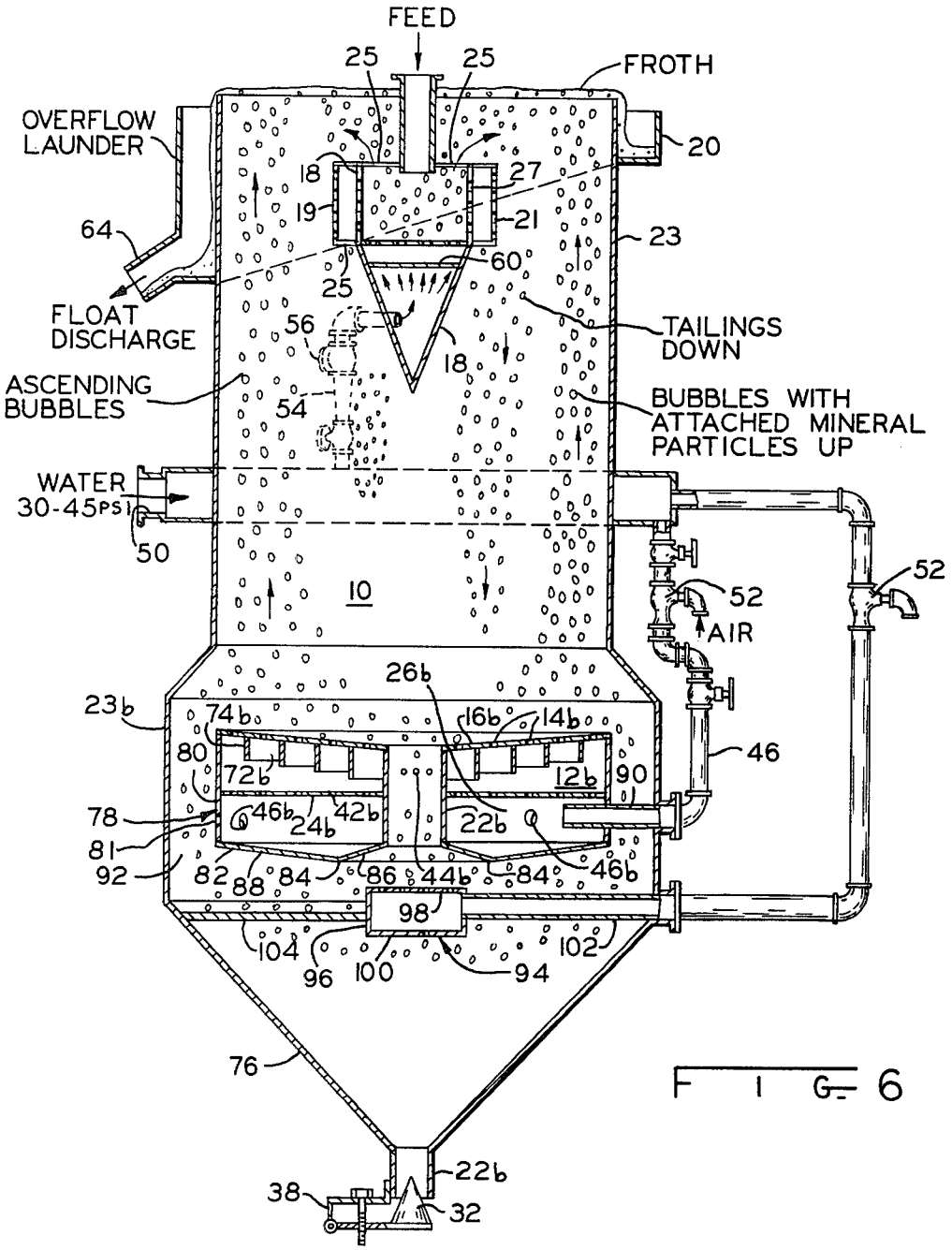
FIG. 6 is a view like FIG. 2 of another embodiment of this invention.

Referring now to FIG. 6, a further embodiment of this invention will now be described in connection with which like numerals indicate like parts. The lower end of the compartment wall 23 is enlarged as indicated by the numeral **23*b* which at its lower end connects into a conically shaped discharge chamber 76 having a discharge pipe 22*b* provided with a valve assembly 32, 38. Coaxially disposed within the enlargement 23*b* is a cylindrical aerating enclosure 78 which contains the hydraulic compartment 12*b* and the aerating chamber 26*b*. The enclosure 78 has a cylindrical wall 80 on the upper end of which is secured the constriction plate 16*b* as shown. The lower end of the wall 80 has secured thereto a bottom plate 82, both the constriction plate 16*b* and bottom plate 82 being secured to the discharge pipe 22*b* which opens therethrough. The bottom plate 82 is configured as shown with an annular ridge 84 and surfaces 86 and 88 which incline therefrom toward the discharge pipe 22*b* and the wall 80, respectively. The reason for this configuration of bottom plate 82** will be explained later.

The enclosure 78 is fixedly secured coaxially within the enlargement **23*b* by means of pipe sections 90 leading from the respective, peripherally arranged water pipes 46, the pipe sections 90 being secured at the opposite ends thereof to the walls of the enclosure 78 and the enlargement 23*b***.

As will be noted in FIG. 6, the diameter of the aerating enclosure 78 is substantially equal to that of the flotation compartment 10 such that the area of the constriction plate **16*b* is essentially coextensive with a projected cross-sectional area of the flotation compartment 10. Thus arranged, the enclosure 78 forms with the enlargement 23*b* an annular outflow duct 92 which communicates with the discharge chamber 76. The cross-sectional area of this outflow duct 92 plus that of the pipe 22*b* provides a relatively large outlet which reduces to a minimum the velocity of water flow from the flotation compartment 10 into the discharge chamber 76. Such low velocity enables the tiny air bubbles to ascend through the flotation compartment 10** to form the froth at the top.

Another or auxiliary compartment indicated generally by the numeral 94 is mounted within the discharge chamber 76 beneath and in coaxial spaced relation with respect to the enclosure 78. This aerating compartment 94 is preferably cylindrical having a peripheral wall 96 to which is secured top and bottom constriction plates 98 and 100, these constriction plates being provided with a series of orifices as previously described. In one arrangement, the number of orifices in the constriction plate 100 are fewer than in the plate 98 or there may be none at all. The compartment 94 is coaxially secured within the discharge chamber 76 by means of one or more pipe extensions 102 which lead from the water piper 46 as well as one or more radiating bars 104 secured at the opposite ends thereof to the wall of the discharge chamber 76 and the wall 96 of the compartment 94.

The compartment 94 is either larger or smaller in diameter than that of the annular ridge 84 on the bottom plate 82 for a purpose which will be explained later.

The operation of this embodiment of FIG. 6 is essentially the same as that of the preceding embodiments, with aerated water being supplied to both the aerating enclosure 78 and the compartment 94. Tiny air bubbles pass through the orifices **14*b* in the constriction plate 16*b* upwardly through the flotation compartment 10 as previously explained. Tiny bubbles in the aerated water delivered to the compartment 94 pass out through the orifices in the two constriction plates 98 and 100, certain of these bubbles which ascend from the plate 98 being directed by the inclined surface 86 into the discharge duct 22*b* from which they pass upwardly into the flotation compartment 10. Other bubbles emerging from the constriction plates 98 and 100 ascend through the bath within the discharge chamber 76 and annular duct 92 into the flotation compartment 10, these bubbles picking up flotable particles which may have escaped from the flotation compartment 10 and were being carried by the low velocity outflow toward the discharge end of the apparatus. It will thus be seen that efficiency in the operation of the apparatus as measured by the quantity of flotable particles separated from the aqueous pulp is enhanced, since those particles which otherwise would be discharged from the apparatus through the downflow ducts encounter ascending bubbles from the auxiliary aerating compartment 94 and are floated upwardly to the upper end of the flotation compartment 10** where they form a part of the overflow froth.

In order to prevent clogging of the constriction plate **16*b*, it may be inclined as shown and as described in connection with the embodiment of FIG. 2**.

Figure 7:
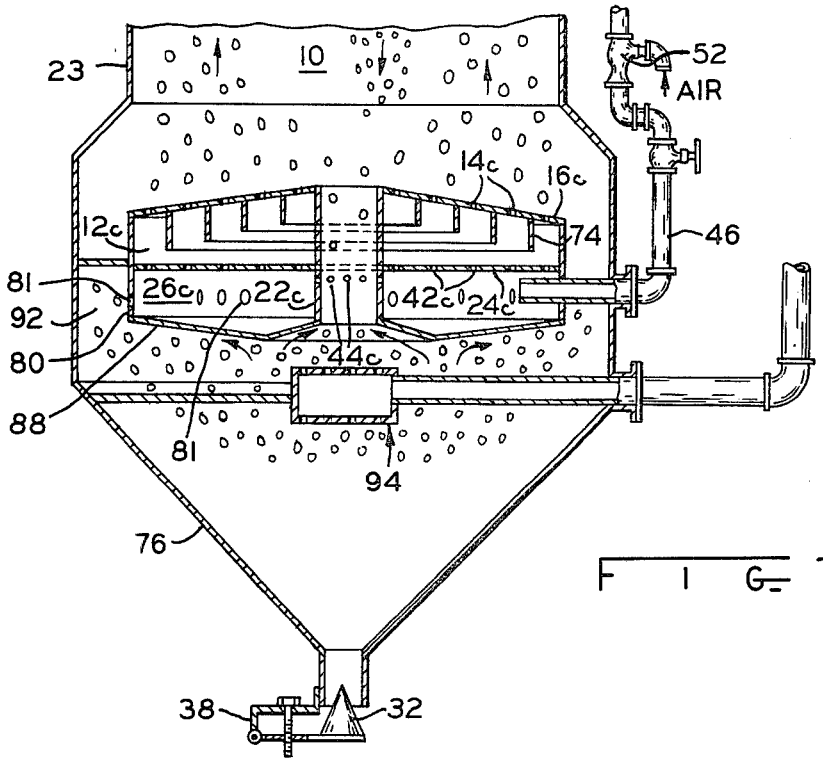
FIGS. 7 and 8 are sectional views of modifications of the embodiment of FIG. 6.

In FIG. 7, the embodiment there shown is essentially identical to that of FIG. 6 with the exception that the constriction plate **16*c* is inclined oppositely to that of 16*b* such that the coarser, non-flotable particles will gravitate outwardly through the annular duct 92**.

The embodiment of FIG. 7 may further be modified as follows. The aerating compartment 94 is omitted, the center duct **22*c* is omitted, the constriction plate 16*c* is extended to fill in the central space otherwise occupied by the duct 22*c* as are the plates 24*c* and 88, the plate 16*c* coming to an apex in the center and both plates 16*c* and 24*c* having orifices 14*c* and 42*c* in the central areas, respectively, which would otherwise coincide with the duct 22*c*. The constriction plate 16*c* would thus be conically shaped. The plate 88 in this instance could be flat, covering the area of duct 22*c*. Further, the aerating enclosure 78 may be of a diameter larger than the compartment 10 and provided in the side wall 80 with a plurality of aerating orifices 81 like orifices 14*c*** and spaced about the same.

This modified FIG. 7 arrangement provides aeration in the central portion of compartment 10 without the need of orifices **44*c* or the aerating compartment 94. The orifices 81 provide aeration in the duct 92 for floating the desired fraction which otherwise would escape therethrough. Non-float fraction which collects on constriction plate 16*c* gravitates toward the periphery to discharge through duct 92**.

Figure 8:
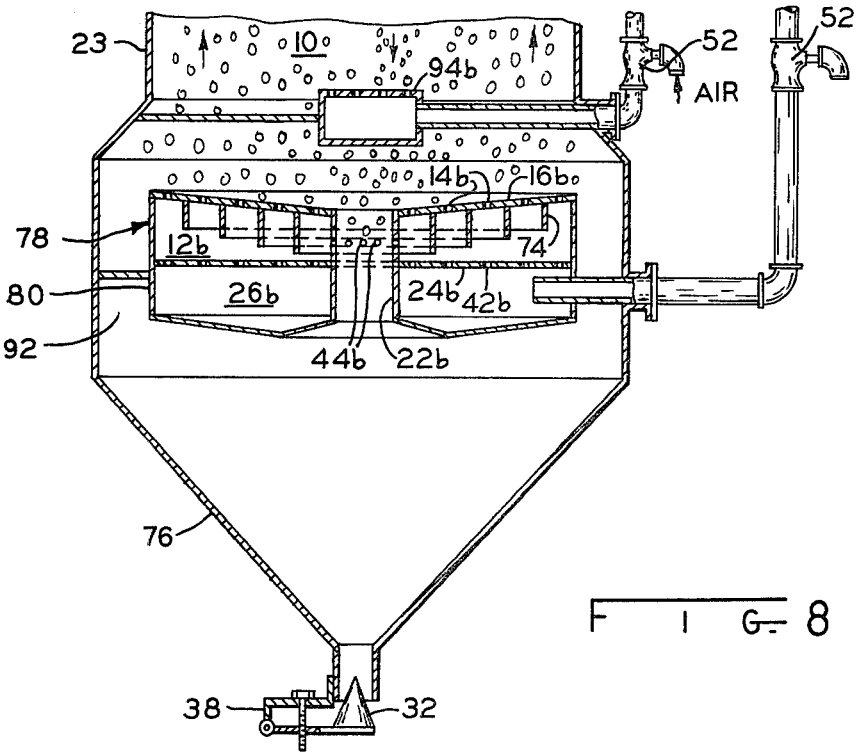

With respect to all of the embodiments of FIGS. 6, 7 and 8, the orifices 81 may or may not be used as desired.

The embodiment shown in FIG. 8 is essentially like that of FIG. 6 with the exception that the compartment 94, here indicated by the numeral **94*b*, is located above the aerating enclosure 78 in vertical alignment with the discharge pipe 22*b*. This compartment 94*b* provides additional aerated water and bubbles to the flotation compartment 23, and more especially to the portion thereof adjacent to the upper end of the discharge pipe 22*b* where additional bubbles are required to inhibit the outflow and loss of flotable particles through the discharge pipe 22*b*. To further enhance the aeration of water within the pipe 22*b*, the orifices 44*b***, previously described, may also be used.

Considering for example the embodiment of FIG. 6, three stages of aeration are provided, one in the form of the feedwell 18, the second the aerating enclosure 78 and the third the auxiliary aerating compartment 94. These three aerating devices are vertically spaced such that primary flotation of the flotable particles occurs by reason of the aerated water supplied to the feedwell 18, secondary flotation by that supplied by the aerating enclosure 78 and tertiary flotation by the bubbles emanating from the auxiliary compartment 94, the secondary and tertiary flotation stages tending to pick up that flotable material which otherwise might escape with the discharge of the unwanted non-flotable particles. The aerating devices are not only arranged in series vertically, but are spaced horizontally (the aerating devices 78 and 94, for example) such that a volume of bubbles are produced throughout the cross section of the flotation compartment to increase the probability of picking up any flotable material which otherwise might be lost. Proper distribution and volume of aeration also minimizes or eliminates the development of recirculating currents which tend to carry off the desired flotable materials along with the non-float aggregate.

With reference to FIGS. 6, 7 and 8, the aerating enclosures 78 have been described as being coextensive with or larger in area than the cross-sectional area of flotation compartment 10. In practice, the size of this enclosure 78, may be larger, equal to or smaller than that of compartment 10 provided adequate aeration of the aqueous pulp in compartment 10 results. The various aeration devices may be selected in different permutations as disclosed to maximize flotation efficiency and recovery of the float fraction.

Figure 9:
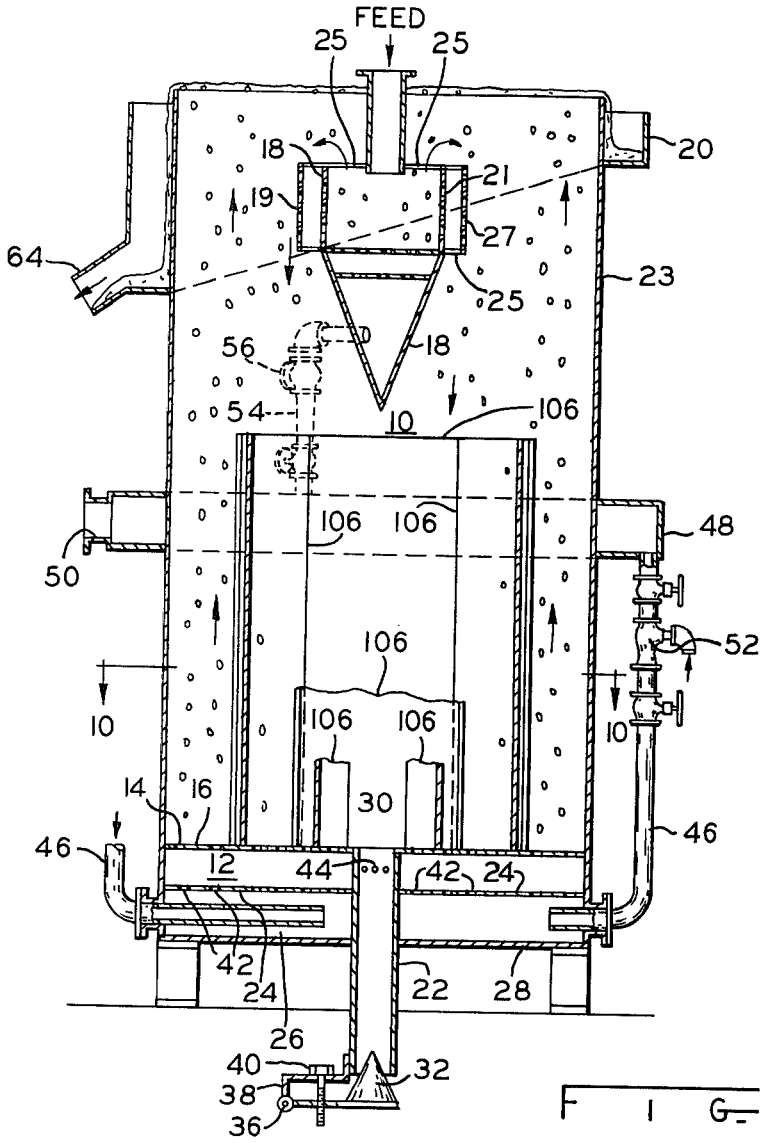
FIG. 9 is a view like FIG. 2 of yet another embodiment.
Figure 10:
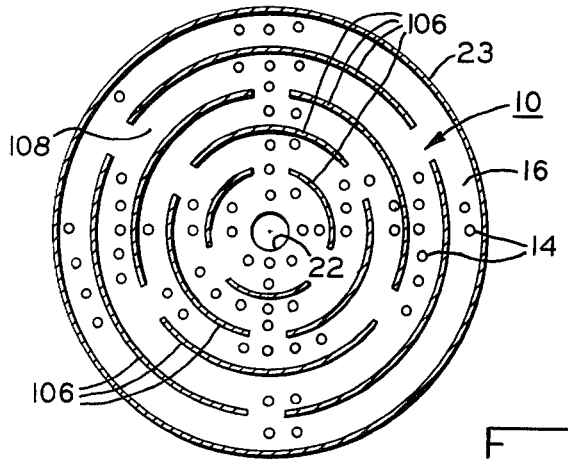
FIG. 10 is a cross-section taken substantially along section line 10—10 of FIG. 9.

Referring to FIGS. 9 and 10, a further embodiment of this invention is disclosed wherein a plurality of baffle plates 106 upstand within the flotation compartment 10. These baffle plates 106 are secured to an upstand from the constriction plate 16 in circumferentially and radially spaced relation, each plate 106, in the preferred embodiment, being arcuately shaped and disposed concentrically of the compartment wall 23 and coaxially with respect to the discharge opening 30. While the various plates 106 may be of different heights, they are shown as having the upper ends thereof disposed just short of the feedwell 18. The plates 106 have radial spaces 108 therebetween such that non-float material tending to settle toward the constriction plate can pass therethrough and migrate inwardly to be discharged from the opening 30.

The number, spacing and arcuate extent of these plates 106 may vary also so long as the development of the circulating or recirculating currents within the flotation compartment 10 are prevented or inhibited. Preferably, in each circle three plates are used, with the plates in adjacent circles being circumferentially staggered in overlapping relation as shown. The orifices 44 in central discharge pipe 22 may or may not be used as desired, depending upon the diameter of the flotation compartment 10. Thus, this embodiment utilizes two different structures for inhibiting or preventing recirculation, these being either the orifices 44 or baffle plates 106, or a combination of the two. The baffle arrangement may also be used with the other disclosed embodiments.

Further as a part of such recirculation or as a separate consideration, the baffle plates 106 are so arranged to inhibit water cross-flow; i.e. flow within the flotation compartment corresponding to the height of the baffle plates which eventually leads out of the discharge duct, whether such duct be in the form as shown in either FIG. 6 or FIG. 9. The recirculating currents developed have a curvilinear, elliptical or circular geometry lying generally in vertical planes which include radii of the flotation compartment and discharge duct, each such current having a horizontal or cross-flow component. These currents result from the upward streams of water through the orifices in the constriction plates which eventually curve toward the discharge duct, and roll or recirculate in the elliptical or circular pattern which terminates through the duct. Other cross-flow theoretically is possible directly from an orifice to the discharge duct.

By providing baffle plates transversely of the cross-flow, such cross-flow is minimized and loss of float fraction out of the discharge duct is inhibited. The pulp is further fluidized in the region above the constriction plate and the particles are maintained in suspension, increasing retention time, thereby increasing the probability of bubble attachment.

Recapitulating, the present forms of the invention provide for multiple stages of aeration, reduces the velocity of outflow of the aqueous pulp to a sufficiently low level that will assure ascendency of the froth-forming bubbles, and eliminates the need for using two or more flotation apparatuses or cells of prior art design in a vertical series arrangement wherein the upper cells discharge into the lower cells, the lower cells in this instance being used for the purpose of recovering any flotable materials lost from the upper cells. Improved efficiency is therefore realized by means of apparatus of minimal overall height.

A further efficiency is realized in the provision of means minimizing or avoiding the development of circulating or recirculating currents within the flotation compartment 10, these means being in the form of either orifices 44 or the baffle plates 106 or a combination of the two. Thus, float fraction which heretofore has become entrained within the recirculating currents has tended to be lost through the discharge duct; however, by reason of the provision of air bubbles in the space of the duct 22 and/or the presence of the baffle plates 106, such recirculating currents are prevented from forming such that the ascending bubbles within the central portion of the flotation compartment 10 capture the float fraction and carry it upwardly.

While there have been described above the principles of this invention in connection with specific apparatus, it is to be clearly understood that this description is made only by way of example and not as a limitation to the scope of the invention.

What is claimed is:

1. Apparatus for separation of minerals from an aqueous pulp containing a mixture of mineral and gangue particles by froth flotation comprising:

a flotation compartment adapted to contain a relatively quiescent body of said aqueous pulp, pulp feed means for introducing aqueous pulp into said flotation compartment, froth overflow means disposed adjacent to the upper end of the flotation compartment for discharging therefrom a float fraction containing floated particles of said aqueous pulp, a hydraulic compartment disposed adjacent to the bottom portion of the flotation compartment, said hydraulic compartment being adapted to contain a body of aerated water maintained at a higher static pressure than that of the aqueous pulp in the lower portion of the flotation compartment, a stationary constriction plate forming the top of said hydraulic compartment and interposed between the flotation compartment and the hydraulic compartment and extending substantially horizontally, said constriction plate having a plurality of spaced orifices for uniformly distributing aerated water thereacross from the hydraulic compartment to the flotation compartment, each orifice being adapted to receive therethrough a stream of aerated water from said hydraulic compartment into the lower portion of said flotation compartment, means for introducing air and water into said hydraulic compartment and for forming a multitude of air bubbles throughout the water in the hydraulic compartment, underflow means for discharging a non-float fraction containing unfloated particles of said aqueous pulp from said flotation compartment, said underflow means including a discharge duct which opens through said constriction plate, means for introducing aerated water into said discharge duct, and means for controlling the velocity of outflow through said discharge duct to a level such that the air bubbles in the last-mentioned aerated water rises into said flotation compartment.

2. The apparatus of claim 1 wherein said discharge duct extends downwardly through said hydraulic compartment, said means for introducing air bubbles into said discharge duct includes a plurality of spaced orifices in said discharge duct in communication with said hydraulic compartment.

3. The apparatus of claim 2 wherein said discharge duct is disposed centrally of said constriction plate and said hydraulic compartment.

4. The apparatus of claim 1 wherein said means for introducing air bubbles into said discharge duct includes an air aspirating device connected to said discharge duct.

5. The apparatus of claim 1 wherein said discharge duct is disposed in the mid-portion of said constriction plate, said constriction plate inclining outwardly from the opening of said discharge duct whereby non-float fraction which tends to collect on said constriction plate will gravitate toward said opening, and including means for selectively distributing aerated water in said hydraulic compartment through said orifices substantially uniformly across said constriction plate, said distributing means including a plurality of bubble-entrapping compartments depending from said constriction plate and encircling said discharge duct, the bottoms of said bubble-entrapping compartments being open and communicating with said hydraulic compartment.

6. The apparatus of claim 5 wherein said bubble-entrapping compartments are concentrically arranged about the opening of said discharge duct through said constriction plate, said bubble-entrapping compartments being formed by tubular walls affixed at one end to said constriction plate and extending downwardly into said hydraulic compartment.

7. The apparatus of claim 6 wherein said means for introducing air bubbles into said discharge duct includes a plurality of spaced orifices in said discharge duct in communication with said hydraulic compartment.

8. The apparatus of claim 1 wherein said hydraulic compartment is enclosed by a top, bottom and peripheral side wall, said constriction plate serving as said top, and including an outflow duct which communicates with the lower portion of said flotation compartment and surrounds said hydraulic compartment, said outflow-controlling means including means for controlling the velocity of outflow through both ducts such that said lastmentioned air bubbles rise into said flotation compartment.

9. The apparatus of claim 8 wherein said discharge duct passes through said constriction plate, said constriction plate radially outwardly of said duct being angled with respect to the horizontal whereby non-float fraction which tends to collect on said constriction plate gravitates toward one of said ducts, and including means for selectively distributing aerated water in said hydraulic compartment through said orifices substantially uniformly across said constriction plate.

10. The apparatus of claim 9 wherein said flotation compartment is of upright columnar form, said hydraulic compartment and the constriction plate thereof being of a size substantially coextensive with the cross-section of said flotation compartment, said outflow duct being in the form of a peripheral enlargement of the lower end portion of said flotation compartment, a discharge chamber connected to the lower end of said peripheral enlargement and in communication with both of said ducts, and said outflow-controlling means including a discharge pipe connected to said discharge chamber and an adjustable valve therefor.

11. The apparatus of claim 8 including a discharge chamber beneath said hydraulic compartment which communicates with both of said ducts, a discharge pipe connected to said discharge chamber, said outflow-controlling means including a valve cooperatively associated with said discharge pipe; said means for introducing air bubbles into said discharge duct including an aerating compartment disposed below said hydraulic compartment, said aerating compartment having a substantially horizontal constriction plate in vertical alignment with said discharge duct whereby air bubbles emanating therefrom levitate through said discharge duct into said flotation compartment, and means for supplying aerated water to said aerating compartment.

12. The apparatus of claim 11 wherein said aerating compartment is an enclosure with spaced top and bottom plates and a side wall, the last-mentioned top plate being said constriction plate of said aerating compartment, said bottom plate of said aerating compartment also being configured as a constriction plate, said bottom of said hydraulic compartment having a portion which inclines toward the bottom end of said discharge duct whereby air bubbles from said aerating compartment are directed toward and into said discharge duct.

13. Apparatus for separation of minerals from an aqueous pulp containing a mixture of mineral and gangue particles by froth flotation comprising:

a flotation compartment adapted to contain a relatively quiescent body of said aqueous pulp, pulp means for introducing aqueous pulp into said flotation compartment, froth overflow means disposed adjacent to the upper end of the flotation compartment for discharging therefrom a float fraction containing floated particles of said aqueous pulp, a hydraulic compartment disposed beneath the flotation compartment, said hydraulic compartment being adapted to contain a body of aerated water maintained at a higher static pressure than that of the aqueous pulp in the lower portion of the flotation compartment, a constriction plate forming the top of said hydraulic compartment and separating the flotation compartment from the hydraulic compartment disposed therebeneath, said constriction plate having a plurality of spaced orifices for uniformly distributing aerated water thereacross from the hydraulic compartment to the flotation compartment, each orifice being adapted to receive therethrough a stream of aerated water from said hydraulic compartment into the lower portion of said flotation compartment, means for introducing air and water into said hydraulic compartment and for forming a multitude of air bubbles throughout the water in the hydraulic compartment, underflow means for discharging a non-float fraction containing unfloated particles of said aqueous pulp from said flotation compartment, said underflow means including a discharge duct which opens through said constriction plate, said constriction plate inclining outwardly from the opening into said discharge duct whereby non-float fractions that tend to collect on said plate gravitate toward said opening, and including means for selectively distributing aerated water in said hydraulic compartment substantially uniformly across said constriction plate, said discharge duct opening being disposed centrally of said constriction plate, and said distributing means including a plurality of bubble-entrapping compartments depending from said constriction plate and encircling said discharge duct, the bottoms of said bubble-entrapping compartments being open and communicating with said hydraulic compartment.

14. The apparatus of claim 13 wherein said compartments are concentrically arranged about the opening of said discharge duct through said constriction plate, said bubble-entrapping compartments being formed by tubular walls affixed at one end to said constriction plate and extending downwardly into said hydraulic compartment.

15. The apparatus of claim 14 wherein said air and water introducing means includes an aerating compartment beneath said hydraulic compartment, a second constriction plate separating said hydraulic compartment from said aerating compartment, said second constriction plate having a multiplicity of spaced orifices which receive therethrough streams of aerated water, and a source of aerated water connected to said aerating compartment.

16. The apparatus of claim 13 wherein said means for selectively distributing aerated water includes a plurality of air bubble entrapping compartments depending from said constriction plate in communication with discrete different ones of said orifices, the bottoms of said bubble-entrapping compartments being open and communicating with said hydraulic compartment.

17. The apparatus of claim 16 wherein said air and water introducing means includes an aerating compartment beneath said hydraulic compartment, a second constriction plate separating said hydraulic compartment from said aerating compartment, said second constriction plate having a multiplicity of spaced orifices, which receive therethrough streams of aerated water, and a source of aerated water connected to said aerating compartment.

18. Apparatus for separation of minerals from an aqueous pulp containing a mixture of mineral and gangue particles by froth flotation comprising:

a flotation compartment adapted to contain a relatively quiescent body of said aqueous pulp, said compartment being in upright columnar form, pulp feed means for introducing aqueous pulp into said flotation compartment, froth overflow means disposed adjacent to the upper end of the flotation compartment for discharging therefrom a float fraction containing floated particles of said aqueous pulp, outflow means disposed adjacent to the lower end of said flotation compartment for discharging therefrom a non-float fraction containing non-floating particles of said aqueous pulp, first and second aerating means for introducing areated water into said flotation compartment adjacent the bottom and throughout the cross-section thereof, said two aerating means being vertically offset, and including two hydraulic compartments, respectively, having the top sides thereof defined by apertured constriction plates, at least a portion of said outflow means being disposed radially within and passing through said first aerating means and the constriction plate thereof and further being in vertical alignment with said second aerating means, whereby aerated water is introduced across the space of said flotation compartment for removing the float fraction of said aqueous pulp therein during discharge of non-float fraction.

19. The apparatus of claim 18 wherein said outflow means is in the form of a discharge duct having upper and lower ends and disposed centrally of said first aerating means, said second aerating means being disposed either above or below said first aerating means in vertical registry with said discharge duct.

20. The apparatus of claim 19 wherein said first and second aerating means include individual hydraulic compartments having horizontally extending constriction plates, respectively, said discharge duct passing through one of said hydraulic compartments.

21. The apparatus of claim 20 including an outflow duct which surrounds said one hydraulic compartment and connects between said discharge chamber and the lower end of said flotation compartment, the other hydraulic compartment being disposed within said discharge chamber, and means for directing air bubbles from said other hydraulic compartment upwardly through both of said ducts and into said flotation compartment.

22. The apparatus of claim 21 wherein said directing means includes a deflecting plate disposed above said other hydraulic compartment and having inclined surface portions leading toward both of said ducts.

23. Apparatus for separation of minerals from an aqueous pulp containing a mixture of mineral and gangue particles by froth flotation comprising:

an upright flotation compartment adapted to contain a relatively quiescent body of said aqueous pulp, pulp means for introducing aqueous pulp into said flotation compartment, froth overflow means disposed adjacent to the upper end of the flotation compartment for discharging therefrom a float fraction containing floated particles of said aqueous pulp, a hydraulic compartment disposed beneath the flotation compartment, said hydraulic compartment being adapted to contain a body of aerated water maintained at a higher static pressure than that of the aqueous pulp in the lower portion of the flotation compartment, means for introducing aerated water into said hydraulic compartment, said hydraulic compartment having horizontally extending, spaced top and bottom plates and an enclosing side wall, an outflow duct surrounding said hydraulic compartment and opening into the lower portion of said flotation compartment, said top plate being in the form of a constriction plate provided with a plurality of spaced orifices for uniformly distributing aerated water thereacross from the hydraulic compartment to the flotation compartment, each orifice being adapted to receive therethrough a stream of aerated water from said hydraulic compartment into the lower portion of said flotation compartment, said constriction plate being raised in the central portion and declining to the perimeter thereof whereby non-float fractions that tend to collect thereon gravitate toward and into said outflow duct, means for introducing aerated water into said hydraulic compartment, and means connected to said top plate but spaced from said bottom plate for selectively distributing aerated water in said hydraulic compartment to discrete orifices in said constriction plate, said distributing means including a plurality of bubble-entrapping compartments depending from said constriction plate and openly communicating in common with said hydraulic compartment, underflow means for discharging residue aqueous pulp from said flotation compartment via said outflow duct.

24. The apparatus of claim 23 including in the side wall of said hydraulic compartment a plurality of aerating orifices which open into said outflow duct.

25. The apparatus of claim 24 wherein said bubble-entrapping compartments are concentrically arranged about the center of said constriction plate and are defined by tubular walls affixed at one end to said constriction plate and extending downwardly into said hydraulic compartment.

26. Apparatus for separation of minerals from an aqueous pulp containing a mixture of mineral and gangue particles by froth flotation comprising:

an upstanding flotation compartment defined by a closure wall adapted to contain a relatively quiescent body of aqueous pulp, means for introducing aqueous pulp into said flotation compartment, means disposed adjacent to the upper end of the flotation compartment for discharging therefrom a float fraction containing floated particles of said aqueous pulp, a stationary constriction plate disposed adjacent to the bottom portion of the flotation compartment and extending generally horizontally, said constriction plate having a plurality of spaced orifices throughout the area thereof, each orifice being adapted to receive therethrough a stream of aerated water from the underside of said constriction plate into the lower portion of said flotation compartment, means for supplying aerated water having a multitude of air bubbles to the underside of said constriction plate which passes upwardly through said orifices, underflow means for discharging a non-float fraction containing unfloated particles of said aqueous pulp from said flotation compartment downwardly beyond said constriction plate, said underflow means including a discharge duct which bypasses said constriction plate, and means for inhibiting the loss of float fraction from said flotation compartment and out of said underflow means, said inhibiting means including a plurality of vertical baffle plates upstanding from said constriction plate, the bottom edges of said baffle plates being immediately adjacent to said constriction plate thereby to inhibit flow of aqueous pulp between said bottom edges and said constriction plate, and said baffle plates further extending transversely of radii extending from the discharge duct.

27. The apparatus of claim 26 wherein said baffle plates are spaced apart peripherally and transversely of said flotation compartment.

28. The apparatus of claim 27 wherein said flotation compartment is of cylindrical shape and said baffle plates are concentrically formed and positioned with respect thereto, the transversely spaced plates being partially overlapped peripherally, said discharge duct being disposed centrally of said constriction plate.

29. The apparatus of claim 27 wherein said baffle plates are curvilinear and concentric about said duct, said baffle plates further being partially overlapped radially of said constriction plate.

30. The apparatus of claim 26 wherein said inhibiting means includes said discharge duct being provided with a plurality of orifices at a location beneath said constriction plate to receive aerated water and a portion of said air bubbles therethrough, and means for controlling the velocity of outflow through said discharge duct such that said last-mentioned air bubbles rise through said discharge duct and into said flotation compartment.

31. For use in froth flotation apparatus a feed-well device comprising a chamber having an open upper end and a closed bottom, a constriction plate dividing said chamber into upper and lower compartments, means for introducing aerated water into said lower compartment, the wall of said upper compartment being provided with a plurality of openings for receiving aerated pulp therethrough.

32. The feed-well device of claim 31 including a pulp-dispersing wall surrounding and spaced from said upper compartment, said wall also being provided with a plurality of openings for receiving aerated pulp therethrough.

33. The device of claim 32 wherein said openings are elongated peripherally of said upper compartment and said wall.

34. Apparatus for separation of minerals from an aqueous pulp containing a mixture of mineral and gangue particles by froth flotation comprising:

an upstanding flotation compartment defined by a closure wall adapted to contain a relatively quiescent body of aqueous pulp, means for introducing aqueous pulp into said flotation compartment, means disposed adjacent to the upper end of the flotation compartment for discharging therefrom a float fraction containing floated particles of said aqueous pulp, a stationary constriction plate disposed adjacent to the bottom portion of the flotation compartment and extending generally horizontally, said constriction plate having a plurality of spaced orifices throughout the area thereof, each orifice being adapted to receive therethrough a stream of aerated water from the underside of said constriction plate into the lower portion of said flotation compartment, means for supplying aerated water having a multitude of air bubbles to the underside of said constriction plate, which aerated water passes upwardly through said orifices, underflow means for discharging a non-float fraction containing unfloated particles of said aqueous pulp from said flotation compartment downwardly beyond said constriction plate, said underflow means including a discharge duct which bypasses said constriction plate, and means for inhibiting the loss of float fraction from said flotation compartment and out of said underflow means by minimizing current cross-flow in said flotation compartment above said constriction plate, said inhibiting means including baffle plates extending transversely of such cross-flow and being upright in said flotation compartment.

35. The apparatus of claim 34 wherein said discharge duct either surrounds or is within said constriction plate.

36. The apparatus of claim 35 wherein said baffle plates are circumferentially and radially spaced in relation to said discharge cut and further extent transversely of raddii of such duct.

* * * * *